United States Patent [19]

Saito et al.

[11] 4,313,814

[45] Feb. 2, 1982

[54] ELECTRODE FOR ELECTROLYSIS AND MANUFACTURE THEREOF

[75] Inventors: Shunjiro Saito; Akio Nakamura; Makoto Kobayashi, all of Tokyo, Japan

[73] Assignee: TDK Electronics Co., Ltd., Tokyo, Japan

[21] Appl. No.: 863,425

[22] Filed: Dec. 22, 1977

[30] Foreign Application Priority Data

Jan. 27, 1977 [JP] Japan ..... 52-8086

[51] Int. Cl.[3] ..... C25B 11/08

[52] U.S. Cl. ..... 204/290 F

[58] Field of Search ..... 204/290 H, 290 F

[56] References Cited

U.S. PATENT DOCUMENTS 3,711,385 1/1973 Beer ..... 204/59 R 3,864,163 2/1975 Beer ..... 148/6.11

FOREIGN PATENT DOCUMENTS 1147442 4/1969 United Kingdom ..... 204/290 F

*Primary Examiner*—F. Edmundson

*Attorney, Agent, or Firm*—Oblon, Fisher, Spivak, McClelland & Maier

[57] ABSTRACT

An electrode for electrolysis comprises a conductive substrate which is coated with a combination of palladium oxide and platinum metal or a combination of palladium oxide and Pt-Pd alloy which comprises 99 to 5 mole % of palladium component as Pd and 1 to 95 mole % of platinum component as Pt and at least 25 wt. % of palladium component being in a form of palladium oxide.

14 Claims, No Drawings

ELECTRODE FOR ELECTROLYSIS AND MANUFACTURE THEREOF

BACKGROUND OF THE INVENTION

1. Field of the Invention

The present invention relates to an improved electrode for electrolysis and a manufacture thereof.

2. Description of the Prior Art

Heretofore, the alkali metal electrolysis such as sodium chloride electrolysis has been mainly carried out by the mercury process. Recently, the pollution of drainage containing mercury component caused by the mercury process has been discussed. The change of the process from the mercury process to diaphragm processes has been required.

The diaphragm processes have been usually worked at higher pH in the electrolysis in comparison with the mercury process. The known electrodes have low oxygen overvoltage. Accordingly, when the known electrodes are used for the diaphragm process or the ion-exchange membrane process about 1 to 3% of oxygen is included in the resulting chlorine, whereby the anolytic gas can not be directly fed into petro-chemical plants etc. It is necessary to use the anolytic gas after removing oxygen. Accordingly, special equipments and complicated operations are required to increase the cost.

In order to overcome the disadvantages, an electrode which causes a smaller generation of oxygen should be used. The electrode potential of oxygen at equilibrium ($E_{O_2}$) is lower than that of chlorine ($E_{Cl_2}$). When an electrode which does not have any selectivity in the electrode reaction of oxygen and chlorine is used, a large amount of oxygen is generated at the potential for generating chlorine.

Thus, in order to reduce the generation of oxygen, it is necessary to use an electrode having a coating which has the characteristic inhibiting oxygen electrode reaction in the theory of reaction rate.

The selectivity of the electrode for the electrode reaction is called as an electrocatalytic activity which has been estimated by an exchange current density of the coating of the electrode.

It has been known that platinum group metals such as Ru, Pd, Rh, Pt and Ir have such electro-catalysis. The exchange current densities of these platinum group metals on the oxygen electrode reaction are as follows.

Ru>Ir>Rh>Pd>Pt.

The exchange current densities on the chlorine electrode reaction are as follows.

Pd>Ru>Ir>Rh>Pt.

From the viewpoints of smaller generation of oxygen and superior electrocatalytic activity on the chlorine electrode reaction, palladium is optimum.

However, in the practical use, when palladium is coated in the form of palladium metal, the palladium metal coating is dissolved in the electrolysis and it can not be practically used because of inferior anticorrosive property.

In order to overcome the disadvantages, it has been proposed to use anticorrosive electrodes made of a Pt-Pd alloy or prepared by coating the Pt-Pd alloy on a substrate or by oxidizing the surface of the Pt-Pd alloy. (B.P. No. 1,147,442, B.P. No. 1,195,871).

However, the electrocatalytic activity of palladium itself could not be imparted because the alloy of palladium is used and the anticorrosive property for a long time of the electrode is not satisfactory.

It has been proposed to use an electrode made of Pt-Pd alloy oxide. (B.P. No. 1,147,442, B.P. No. 984,973). In order to form the alloy oxide on a titanium substrate, it is necessary to treat it at high temperature in the atmosphere of oxygen under high pressure. In the treatment, the titanium substrate is severely oxidized to be difficult for using it as the electrode. Accordingly, in the proposed method, the Pt-Pd alloy is coated on the titanium substrate and the alloy oxide is formed by the anodic oxidation. The characteristics of the electrode are substantially the same with those of the electrode prepared by oxidizing the surface of the Pt-Pd alloy.

On the other hand, the inventors have studied to coat palladium oxide on a substrate made of titanium etc. However, the adhesiveness of the titanium substrate and the palladium oxide is not enough, and it has not been succeeded.

The inventors have further studied and have succeeded to obtain an electrode which can be practically used, by adding a small amount of the other metal oxide to a large amount of palladium oxide to improve the mechanical strength. However, it has not been succeeded to decrease the consumption of the electrode to substantially zero.

The inventors have further studied the reason why the perfect anticorrosive property can not be attained by coating palladium oxide on the titanium substrate and have found that the corrosion is caused by a small amount of metallic palladium. That is, when titanium is directly contacted with palladium oxide or the unreacted palladium compound in the preparation of the palladium oxide coating on the titanium substrate in the thermal decomposing process, the palladium compound is reduced with titanium whereby metallic palladium is formed to contaminate the palladium oxide.

Accordingly, it is considered that the anticorrosive property is deteriorated by using the electrode having the improved mechanical strength for a long time because the metallic palladium formed by the reduction is dissolved in the electrolysis and the coated layer becomes porous and the coating is fallen down with the generation of the gas from the surface of the electrode.

The inventors have found from these facts that the consumption of the electrode can be completely prevented by removing a small amount of metallic palladium as the by-product by forming an alloy with platinum in the thermal decomposing process for forming the palladium oxide coating. The present invention has been attained by these findings.

SUMMARY OF THE INVENTION

It is an object of the present invention to provide an electrode for electrolysis which has high anticorrosive property of no consumption for a long operation with high selectivity for a chlorine electrode reaction.

The foregoing and other objects of the present invention have been attained by providing an electrode for electrolysis which comprises a conductive substrate such as titanium, tantalum or zirconium which is coated with a combination of palladium oxide and platinum or a combination of palladium oxide and Pt-Pd alloy which comprises 99 to 5 mole % of palladium component as Pd and 1 to 95 mole % of platinum component as Pt and at least 25 wt. % of palladium component being in a form of palladium oxide.

DETAILED DESCRIPTION OF THE PREFERRED EMBODIMENTS

The electrode of the present invention can be prepared by dissolving a palladium compound which can be thermally decomposed such as palladium chloride at a ratio of 99 to 5 mole % as Pd and a platinum compound which can be thermally decomposed such as platinum chloride at a ratio of 1 to 95 mole % as Pt in a solvent and then coating the solution on a conductive substrate and thermally decomposing them in the presence of oxygen to form a coating of a combination of palladium oxide and platinum metal or a combination of palladium oxide and Pt-Pd alloy on the surface of the conductive substrate.

The condition for the thermal decomposition should be selected so as to convert at least 25 wt. % of palladium component to palladium oxide. Thus, the mixture of palladium oxide and platinum or the mixture of palladium oxide and Pt-Pd alloy is formed on the surface of the substrate whereby the particle diameter of palladium oxide which highly affects to the electrode catalytic function is controlled to about several hundreds Å and the resulting alloy phase forms segregation phase at the interface of the palladium oxide particles and the dense and active coating is formed to obtain the electrode having high anticorrosive property.

The electrode of the present invention imparts excellent stability for the electrode catalytic function because of the following reasons.

The chlorine overvoltage $\eta_{Cl_2}$ of the palladium oxide type electrode relates to the particle size of the palladium oxide particles. In the system of only palladium oxide, there is no function for controlling the growth of the palladium oxide particles whereby the particles grow without any control. In the multi-coating method, longer time for the heat treatment is given for the lower layer whereby the particle sizes of the lower layer is larger than those of the upper layer. When the electrode having such structure is used in the electrolysis, the surface part of the electrode is corroded to appear the inner layer whereby the particle sizes of the exposed palladium oxide particles are larger and the electrode catalytic function is lowered.

On the contrary, in the electrode of the present invention, the growth of the palladium oxide particles is controlled as described above, the particle diameters of the palladium oxide particles are remarkably smaller than those of the only palladium oxide. Even though the inner layer is exposed by a corrosion, the chlorine overvoltage and the oxygen overvoltage are not deteriorated except lowering the effective area for catalytic activity.

In the electrode of the present invention, the ratio of palladium component in the alloy is decreased that is the content of the platinum component is increased, the anticorrosive property is preferably improved. When the content of the platinum component in the composition is higher than 95 mole % as one method of increasing the platinum component in the alloy, the passive state phenomenon is caused to deteriorate the catalytic activity. On the other hand, when the content of the palladium component is higher, the chlorine overvoltage is advantageously lower. However, when the content of the palladium component is more than 99 mole %, the anticorrosive property is lowered.

It is necessary to convert at least 25 wt. % of the palladium component to palladium oxide. When the content of palladium oxide is lower, the electrode catalytic function is remarkably lowered in the electrolysis for a long time.

The reason is considered as follows. When the formation of palladium oxide is small, the chlorine overvoltage $\eta_{Cl_2}$ in the electrolysis current density can not be given only by the palladium oxide and certain current is fed to the alloy part to deteriorate the electrode. When the formation of palladium oxide is controlled by the variation of the metal content, it is considered that the chlorine overvoltage $\eta_{Cl_2}$ is varied depending upon the formation of palladium oxide. Even though the ratio of platinum component to palladium component in the composition is the same, the oxidation of palladium is proceeded to increase the formation of palladium oxide, the catalytic activity for the generation of chlorine can be imparted by the resulting palladium oxide whereby the current passed through Pt-Pd alloy can be reduced and excellent catalytic activity of palladium oxide can be effectively utilized.

The palladium compounds and the platinum compounds which can be thermally decomposed for the preparation of the electrode of the present invention include halides and organic carboxylic acid salts such as acetates of palladium or platinum. The solvents dissolving these compounds include water and alcohols.

The concentration of these compounds in the solvent is usually 5 to 100 g/liter as total metals. In this case, it is preferable to use a dilute solution and to heat-treat for a long time in the thermal decomposition because of higher conversion to form palladium oxide.

The conditions of thermal decomposition are preferably to control the oxygen partial pressure to 0.002 to 0.5 atm. and the bake at 400° to 800° C. for 5 to 10 minutes in each coating and to repeat the operation for several times and then to bake for 30 to 60 minutes at the final step. It is advantageous to bake at 550° C. for 5 to 10 minutes in each coating and to repeat the operation for 6 to 8 times and then, to bake for 10 to 60 minutes in the 9th to 10th times in the thermal decomposition.

The accelerated test for the anticorrosive property of the electrode of the present invention was carried out by the Vaaler's method (J. Electro Chem. Soc., 117, 219 (1970)) with the chlorine saturated aqueous solution of sodium chloride (2.5 mole/liter) at 65° C. at pH of 3 in the current density of 100 A/dm$^2$ in the electrolysis.

The present invention will be further illustrated by certain references and examples.

REFERENCE

A titanium disc substrate having a diameter of 13 mm and a thickness of 1 mm, was washed for dewaxing with a surfactant and the surface of the substrate was dissolved by treating it with 10% aqueous solution of oxalic acid at 80° C. for 30 minutes.

A solution of 833 mg of palladium chloride in 1 ml of HCl and 9 ml of butyl alcohol was coated on the substrate and baked at 550° C. for 5 minutes in air and the operation was repeated for 8 times and then, the operation was repeated except baking for 10 minutes in the 9th and 10th operations, whereby an electrode was prepared. The electrode was analyzed by the X-ray diffraction to find that the product of the layer consists of palladium oxide and palladium metal formed by the reduction with titanium.

An electrolysis of a chlorine saturated aqueous solution of NaCl (2.5 mole) was carried out at 65° C. at pH of 3 in the current density of 100 A/dm$^2$ by using the resulting electrode (Vaaler's accelerated test). After several hours from the initiation of the electrolysis, the cell voltage was remarkably increased whereby, the electrolysis was stopped. After the stop of the electrolysis, the electrode was analyzed by the fluorescent X-ray analysis. As the results, it was found that 27 wt. % of the content palladium component was decreased as a dissolved loss and the chlorine overvoltage of the electrode at 30° C. in 5 M-NaCl aq. sol. at pH of 3 in a current density of 20 A/dm$^2$ was remarkably decreased from 0.017 V at the initiation to 0.210 V.

In accordance with the same process except baking at 550° C. for 5 minutes in the 1st to 8th operations and for 30 minutes in the 9th and 10th operations in air, an electrode was prepared. In the electrolysis, the electrocatalytic activity was suddenly decreased and the chlorine overvoltage $\eta_{Cl_2}$ at the initiation was remarkably low as 0.15 to 0.25 mV. The electrode was improper as an electrode for the electrolysis to produce sodium hydroxide.

When an electrode was separately prepared by baking at higher temperature, the electro catalytic activity was inferior.

When an electrode was separately prepared by baking at lower temperature, the electorde catalytic function was high but a corrosion was easily caused to decrease the electrode catalytic function.

EXAMPLE 1

A solution for coating was prepared by dissolving palladium chloride (Pd $Cl_2$) and chloroplatnic acid ($H_2PtCl_4.6H_2O$) and hydrochloric acid in butyl alcohol at a ratio of 0.2 g/ml of total metal contents and a mole ratio of Pd to Pt of 25:75.

The solution was coated on the titanium disc substrate of Reference and baked at 550° C. for 5 minutes in air and the operation was repeated for 8 times and then, the operation was repeated except baking for 30 minutes in the 9th and 10th operations, whereby an electrode was prepared. The electrode was analyzed by a rotor flex X ray diffraction tester (high power) to find that the product consists of Pt-Pd alloy (mole ratio; Pt:92; Pd:8) and palladium oxide (PdO) and about 74 wt.% of the palladium component was oxidized.

In accordance with the process of Reference, the accelerated electrolysis test was carried out by using the electrode as the anode, the cell voltage was not changed even after 2000 hour operation to maintain about 2.0 V. and the electrolysis could be continued at a constant voltage.

After the electrolysis, the electrode was analyzed by the fluorescent X-ray analysis. As the results, it was found that only about 1.0 wt.% of the content of palladium component and the content of platinum component were decreased as losses of Pd and Pt and the chlorine overvoltage of the electrode at 30° C. in 5 M-NaCl aq. sol. at pH of 3 was substantially the same with the chlorine overvoltage at the initiation of 0.017 and the oxygen overvoltage $\eta_{O_2}$ of the electrode at 30° C. in 1 M-$H_2SO_4$ aq. sol. in a current density of 2 A/dm$^2$ was 0.60 V.

In accordance with the same process except baking it in nitrogen instead of oxygen, an electrode having a coated alloy layer (mole ratio: Pd:25; Pt:75) was prepared and it was used for the electrolysis in the same condition. As the results, the cell voltage was suddenly increased from about 2.2 V to 3.0 V after several hours whereby the electrolysis was stopped.

At this time, the loss of the palladium component was about 10 wt.% and the chlorine overvoltage was increased from about 0.1 V at the initiation to 0.3 to 0.4 V.

The electrode having a coated alloy layer was baked at 550° C. for 1 hour in air. When the resulting electrode was used in the electrolysis the cell voltage was gradually increased from about 2.0 V at the initiation to about 3.0 V after 200 hours whereby the electrolysis was stopped. At this time, the loss of the palladium component was about 30 wt.% to the initial content and the chlorine overvoltage was remarkably increased from 0.020 V at the initiation to 0.2 to 0.25 V.

The electrodes of the present invention had excellent anticorrosive property and stable catalytic function in comparison with the conventional alloy type electrodes and the conventional electrode having an alloy coated layer which were oxidized under a heat treatment.

The results are shown in Table 1.

TABLE 1

| Type of electrode | Chlorine overvoltage $\eta Cl_2$ (V) initiation | after electrolysis | Loss of Pd component (%) |
|---|---|---|---|
| PdO + (Pd—Pt alloy) | 0.017 | 0.020 (after 2000 hr.) | 1.0 (after 2000 hr.) |
| Pd—Pt alloy | 0.10 | 0.30 to 0.40 (after 5 hr.) | 10 (after 5 hr.) |
| (Pd—Pd) oxide | 0.020 | 0.20 to 0.25 (after 200 hr.) | 30 (after 200 hr.) |

EXAMPLE 2

Various solutions for coating were prepared by varying the mole % of the metal components.

In accordance with the process of Example 1, they were respectively coated on the titanium disc substrate and baked at 550° C. for 5 minutes in air and the operation was repeated for 8 times and then, the operation was repeated except baking at 550° C. for 30 minutes for the last 2 times, whereby electrodes having a coated layer consisting of palladium oxide and Pt-Pd alloy were prepared.

The mole ratios of Pt to Pd in the alloy and the conversions from Pd to PdO in the resulting electrodes are shown in Table 2.

TABLE 2

| Charged (mole %) Pt | Pd | Concentration of metal components in butyl alcohol: 50 g/l Pt-Pd (mole %) | PdO conversion | 15 g/l Pt-Pd (mole %) | PdO conversion | 5 g/l Pt-Pd (mole %) | PdO conversion | 2 g/l Pt-Pd (Mole %) | PdO conversion |
|---|---|---|---|---|---|---|---|---|---|
| 94 | 6 | 94.6–5.4 | 11% | 96.0–4.0 | 35% | 98.5–1.5 | 76% | *100-0 | –100% |
| 91 | 9 | 93.4–6.6 | 29% | 94.6–5.4 | 42% | — | | — | — |
| 85 | 15 | 90.8–9.2 | 43% | 94.2–5.8 | 65% | 96.3–3.7 | 78% | — | — |
| 79 | 21 | — | — | 92.6–7.4 | 70% | — | | — | — |

TABLE 2-continued

| Charged (mole %) Pt | Pd | Concentration of metal components in butyl alcohol 50 g/l Pt-Pd (mole %) | PdO conversion | 15 g/l Pt-Pd (mole %) | PdO conversion | 5 g/l Pt-Pd (mole %) | PdO conversion | 2 g/l Pt-Pd (Mole %) | PdO conversion |
|---|---|---|---|---|---|---|---|---|---|
| 75 | 25 | 87.4-12.6 | 57% | 92.2-7.8 | 75% | 94.7-5.3 | 83% | — | — |
| 60 | 40 | 81.0-19.0 | 65% | — | — | — | | — | — |
| 30 | 70 | 60-40 | 71% | 72-28 | 83% | 83-17 | 91% | — | — |
| 5 | 95 | 26-74 | 85% | 35-65 | 90% | 48-52 | 94% | — | — |

*only Pt was detected in experimental allowance.

In accordance with the Vaaler's accelerated test of Reference, the accelerated electrolysis tests were carried out by using the resulting electrodes. The results are shown in Table 3.

TABLE 3

| Composition of coated layer of electrode Pt-Pd (mole %) | PdO conversion | Chlorine overvoltage $\eta Cl_2$ initiation | after 100 hr. | Condition |
|---|---|---|---|---|
| 94.6-5.4 | 11% | 0.040 | 0.470 | cell voltage gradually increase passive state of Pt. |
| 95.4-5.6 | 25% | 0.030 | 0.040 | no change in operation |
| 96.0-4.0 | 35% | 0.030 | 0.040 | no change in operation |
| 93.4-6.6 | 29% | 0.028 | 0.042 | no change in operation |
| 94.6-5.4 | 42% | 0.028 | 0.035 | no change in operation |

As it is clear from these results, even through the content of the palladium component in charge was low, when the conversion to palladium oxide was more than 25 wt.%, the stable characteristics could be maintained in the electrolysis for 100 hours. However, when the conversion to palladium oxide was less such as 11 wt.%, the deterioration of the characteristic during the long operation of the electrolysis was remarkable.

What is claimed is:

1. An electrode for electrolysis, which comprises:

a conductive metal substrate of titanium, zirconium or tantalum having coated thereon a layer consisting of a combination of palladium oxide and platinum metal or a combination of palladium oxide and Pt-Pd alloy wherein on a basis of 100 mole percent palladium and platinum metal in said coating, palladium constitutes 99 to 5 mole percent of the total noble metal content and platinum metal constitutes 1 to 95 mole percent of the total noble metal content and wherein at least 25 weight percent of the palladium component of said coating exists in the form of palladium oxide.

2. An electrode according to claim 1 wherein the conductive substrate is made of titanium.

3. An electrode according to claim 1 wherein the coated layer is formed by baking a coated solution of palladium compound and platinum compound in the presence of oxygen.

4. An electrode according to claim 3 wherein the coated layer is formed by repeating the baking of the coated solution of palladium compound and platinum compound in the presence of oxygen.

5. The electrode according to claim 1, wherein sai conductive substrate is zirconium.

6. A process for preparing an electrode for electrolysis which comprises:

coating a solution containing 99 to 5 mole percent of a thermally decomposable palladium compound and 1 to 95 mole percent of a thermally decomposable platinum compound in a solvent on a conductive metal substrate of titanium, zirconium or tantalum; and thermally decomposing said platinum and palladium compounds in the presence of oxygen to form a coated layer consisting of a mixture of palladium oxide and platinum metal or a mixture of palladium oxide and a Pt-Pd alloy wherein on a basis of 100 mole percent palladium and platinum metal in said coating, palladium constitutes 99 to 5 mole percent of the total noble metal content and platinum metal constitutes 1 to 95 mole percent of the total noble metal content and wherein at least 25 weight percent of the palladium component of said coating exists in the form of palladium oxide.

7. A process according to claim 6 wherein the solvent is water or an alchol.

8. A process according to claim 6 wherein the palladium compound is a halide or a carboxylic acid salt.

9. A process according to claim 6 wherein the platinum compound is a halide, a carboxylic acid salt or a haloplatinic acid.

10. A process according to claim 6 wherein the solution is coated and baked to decompose the palladium compound and the platinum compound and the operation is repeated.

11. A process according to claim 6 wherein the solution contain an acid.

12. The process of claim 6, wherein the concentration of said thermally decomposable compounds in said solution ranges from 5 to 100 grams/liter based on the metals.

13. The method of claim 6, wherein said compounds are thermally decomposed several times at 400° to 800° C. for five to ten minutes for each period of decomposition under an oxygen partial pressure of 0.002 to 0.5 atms.

14. The process of claim 13, wherein said compounds as a coating are thermally decomposed six to eight times at 550° for five to ten minutes and then baked for 10 to 20 minutes in the 9th and 10th times of repetitive decomposition.

* * * * *